US006572515B2

(12) United States Patent
De La Garza

(10) Patent No.: US 6,572,515 B2
(45) Date of Patent: Jun. 3, 2003

(54) DUMBBELL AND BARBELL STABILIZER-ISOLATOR DEVICE

(76) Inventor: Alfonso De La Garza, 1240 Coan St., Chesterton, Porter County, IN (US) 46304

( * ) Notice: Subject to any disclaimer, the term of this patent is extended or adjusted under 35 U.S.C. 154(b) by 54 days.

(21) Appl. No.: 09/881,412

(22) Filed: Jun. 14, 2001

(65) Prior Publication Data

US 2002/0002105 A1 Jan. 3, 2002

Related U.S. Application Data

(60) Provisional application No. 60/211,409, filed on Jun. 14, 2000.

(51) Int. Cl.[7] ..... A63B 21/072

(52) U.S. Cl. ..... 482/106; 482/108; 482/139

(58) Field of Search ..... 482/92, 93, 98, 482/139, 105–109, 905; 135/71; D21/679, 681, 682

(56) References Cited

U.S. PATENT DOCUMENTS

| | | | | | |
|---|---|---|---|---|---|
| 2,617,650 | A | * | 11/1952 | Landis | 482/108 |
| 4,109,908 | A | * | 8/1978 | Pugh et al. | 482/105 |
| 4,312,506 | A | * | 1/1982 | Brennan | 482/106 |
| 4,327,908 | A | * | 5/1982 | James | 482/105 |
| 4,607,840 | A | * | 8/1986 | Harper | 482/108 |
| D290,485 | S | * | 6/1987 | Suponitsky | D21/681 |
| 4,688,789 | A | * | 8/1987 | Alter | 135/71 |
| 4,903,962 | A | | 2/1990 | Pollack | |
| 4,964,631 | A | * | 10/1990 | Marano | 482/105 |
| 5,110,119 | A | * | 5/1992 | Arnold | 482/108 |
| 5,350,345 | A | * | 9/1994 | Frey | 482/105 |
| 5,571,065 | A | * | 11/1996 | Buitoni | 135/71 |
| 5,573,484 | A | * | 11/1996 | Carpenter | 482/108 |

FOREIGN PATENT DOCUMENTS

| | | | | |
|---|---|---|---|---|
| GB | 2230708 A | * | 10/1990 | 482/108 |
| JP | 9-206404 | * | 8/1997 | |

* cited by examiner

*Primary Examiner*—Jerome W. Donnelly
*Assistant Examiner*—Victor K. Hwang
(74) *Attorney, Agent, or Firm*—Gary M. Hartman; Domenica N. S. Hartman; Hartman & Hartman

(57) ABSTRACT

A stabilizer-isolator device for a weightlifting bar, in which the stabilizer-isolator device is capable of stabilizing and isolating exercised muscles with less stress on the tendons. The stabilizer-isolator device generally includes a pair of brace bars having corresponding first and second ends, an annular-shaped collar interconnecting the second ends of the brace bars, and at least one isolator bar substantially transverse to the brace bars and interconnecting the brace bars so as to be spaced apart from the first and second ends of the brace bars. The first ends of the brace bars are adapted to be permanently or removable attached to the weightlifting bar. The collar is disposed in a plane substantially transverse to the brace bars and defines an opening therein. The at least one isolator bar may comprise a single member with a flat surface, or at least two parallel members spaced apart from each other.

16 Claims, 1 Drawing Sheet

DUMBBELL AND BARBELL STABILIZER-ISOLATOR DEVICE

CROSS REFERENCE TO RELATED APPLICATIONS

This application claims the benefit of U.S. Provisional Application No. 60/211,409, filed Jun. 14, 2000.

STATEMENT REGARDING FEDERALLY SPONSORED RESEARCH

Not applicable.

BACKGROUND OF THE INVENTION (1) Field of the Invention

The present invention generally relates to weight lifting equipment.

(2) Description of the Related Art

Barbells and dumbbells are known types of weightlifting equipment in which a weightlifting bar is used to support disk-shaped weights at its opposite ends. Barbells are generally long such that two hands are used when lifting, while dumbbells are shorter to allow lifting with one hand. Aside from the simple rod-shaped weightlifting bars widely known and used by weight lifters, various types and forms of weightlifting bars are known. One such example is a weightlifting bar disclosed in U.S. Pat. No. 4,903,962. Many modifications to weightlifting bars are directed to improving safety, such as improvements in collars used to secure weights to a bar. From the standpoint of safety to the user, further improvements are still desirable.

BRIEF SUMMARY OF THE INVENTION

The present invention provides a stabilizer-isolator device for a weightlifting bar, in which the stabilizer-isolator device is capable of stabilizing and isolating exercised muscles with less stress on the tendons. The stabilizer-isolator device generally includes a pair of brace bars having corresponding first and second ends, an annular-shaped collar interconnecting the second ends of the brace bars, and at least one isolator bar substantially transverse to the brace bars and interconnecting midportions of the brace bars so as to be spaced apart from the first and second ends of the brace bars. The first ends of the brace bars are adapted to be permanently or removable attached to the weightlifting bar. The collar is disposed in a plane substantially transverse to the brace bars and defines an opening therein. The at least one isolator bar may comprise a single member with a flat surface, or at least two parallel members spaced apart from each other. The stabilizer-isolator device of this invention makes possible a weightlifting method in which a user inserts his/her arm through the collar and grips the weightlifting bar with their hand so that the at least one isolator bar is positioned against the wrist of the user's arm and a portion of the collar is positioned against a forearm region of the user's arm between the wrist and the elbow. When lifting the weightlifting bar, the at least one isolator bar applies force against the user's wrist and the portion of the collar applies force against the user's forearm region, thereby achieving a stabilizing effect.

According to the present invention, in addition to the above-noted stabilizing effect, the stabilizer-isolator device provides an improvement in the field of body building and weight training of certain muscles of the body through different angle and exercise selection, done for the purpose of producing different growth responses in different muscles as well as within different regions of the muscle. Other objects and advantages of this invention will be better appreciated from the following detailed description.

DETAILED DESCRIPTION OF THE INVENTION

Figure 1:
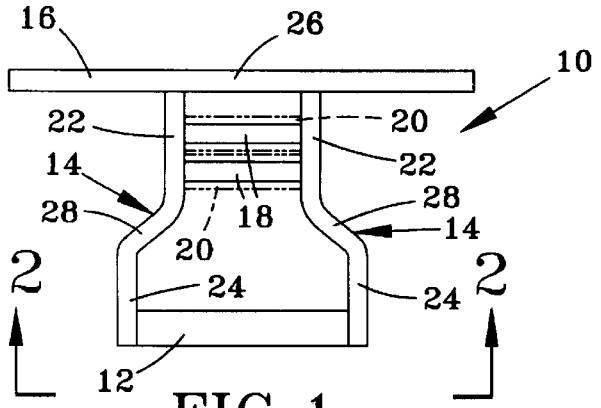
FIG. 1 is a side view of a dumbbell equipped with a stabilizer-isolator device in accordance with a first embodiment of this invention.
Figure 2:
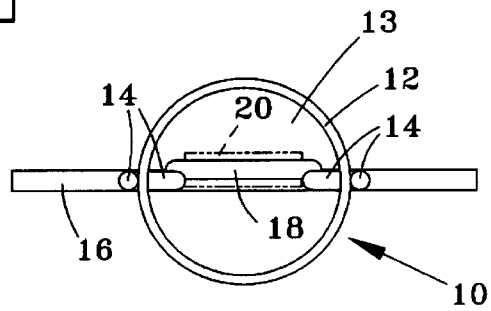
FIG. 2 is an end view of the stabilizer-isolator device mounted to the dumbbell of FIG. 1.

The present invention is a stabilizer-isolator device that provides the advantage of stabilizing and isolating exercised muscles with less stress on the tendons. With reference to FIGS. 1 and 2, a stabilizer-isolator device 10 is shown as being part of a weightlifting bar 16, shown as a dumbbell. The device 10 includes a stabilizer collar 12 coupled to the ends of a pair of stabilizer brace bars 14, which in turn are secured at their opposite ends to the bar 16. The collar 12 is shown as having an annular shape to define an opening 13 therein, and disposed in a plane substantially transverse to the brace bars 14. Each brace bar 14 comprises two substantially parallel but offset sections 22 and 24 interconnected by a midsection 28, such that the brace bars 14 are closer to each other at the bar 16 than at the collar 12. A grip 26 is provided on the bar 16 between the brace bars 14. A pair of isolator bars 18 extend between the brace bars 14 adjacent the bar 16, at the sections 22 of the brace bars 14. The isolator bars 18 are offset from the diametrical chord of the collar 12 as seen in FIG. 2, such as by being attached to the sides of the brace bars 14.

The collar 12, brace bars 14 and isolator bars 18 can be formed of any suitable structural materials. While the brace bars 14 and isolator bars 18 are preferably formed of a metal to allow assembly by welding or brazing, the collar 12 may be formed of leather, plastic, a webbing material, or another nonrigid material. While being shown as permanently attached (metallurgically bonded) to the bar 16, the brace bars 14 could be mechanically attached. For comfort of the user, a foam or rubber padding 20 preferably covers each isolator bar 18.

The dual isolator bars 18 significantly improve the ability to isolate those muscles intended to be worked by the user. In use, the user places his or her hand through the opening 13 in the collar 12 and then grips the bar 16, with the inside of his or her wrist resting against the dual isolator bars 18 and the collar 12 resting against the forearm between the wrist and elbow. In this manner, the dual isolator bars 18 provide support for the wrist, thereby stabilizing the wrist and forearm while also stabilizing and isolating the muscles of the forearm and upper arm for exercise. The use of two isolator bars 18 has been determined to provide greater stability and comfort to the user, as well as reduces stress on the tendons of the forearm. The collar 12 further stabilizes the forearm and maintains contact between the isolator bars 18 and the wrist. Through different angle and exercise selection, the arm can be worked to produce different growth responses in different muscles of the arm as well as within different regions of the muscle.

Figure 3:
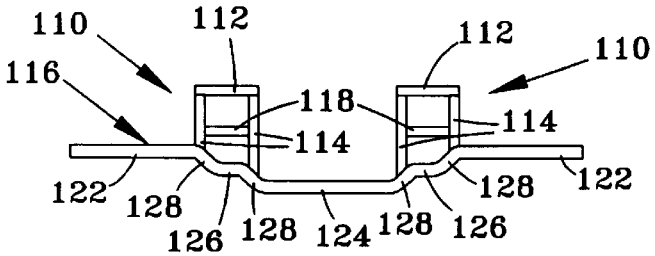
FIG. 3 is a side view of a barbell equipped with the stabilizer-isolator device in accordance with a second embodiment of this invention.
Figure 4:
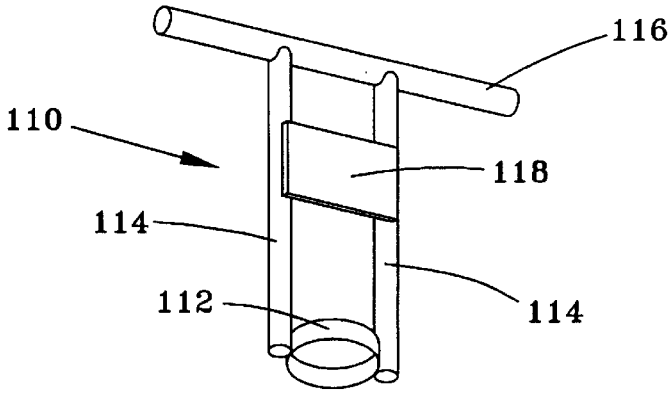
FIG. 4 is a side view of a dumbbell equipped with a stabilizer-isolator device in accordance with a third embodiment of this invention.

FIGS. 3 and 4 represent a stabilizer-isolator device 110 in accordance with a second embodiment of the invention. In FIG. 3, two of the stabilizer-isolator devices 110 are shown mounted to a barbell 116, e.g., a well-known Olympic weight bar. The devices 110 are shown as extending generally parallel to each other from the bar 116, spaced apart on the bar 116 a distance sized for comfort by the user. While the dumbbell 16 shown in FIGS. 1 and 2 is straight, the barbell 116 is shown made up of sections that are not coaxial with each other. More particularly, the barbell 116 has two oppositely-disposed end sections 122 that are substantially coaxial with each other, and a midsection 124 therebetween that is substantially parallel to the end sections 122 but not coaxial with the end sections 122 so that the midsection 124 is axially offset from the end portions 122. The barbell 116 further includes a pair of grips 126, one each between the midsection 124 and each end section 122. Finally, interconnecting sections 128 are disposed between each grip 126 and its adjacent end section 122 and midsection 124. The interconnecting sections 128 provide for the offset of the midsection 124 relative to the end sections 122, as well as a lesser offset between the grips 126 and the end sections 122, and are therefore nonparallel to the end sections 122 and midsection 124. Finally, the brace bars 114 of each stabilizer-isolator device 110 are attached to the interconnecting sections 128 such that each grip 126 is straddled by the brace bars 114 of one of the devices 110. The stabilizer-isolator devices 110 extend outward from the barbell 116 in a diametrically opposite direction to the offset of the midsection 124 and grips 126. In this manner, the offsets of the midsection 124 and the grips 126 provide improved comfort to the user.

FIG. 4 is a detailed view of one of the isolator-stabilizer devices 110 secured to a dumbbell 16, which is shown as being essentially identical to that shown in FIGS. 1 and 2, and therefore identified with the same reference number. Similar to the device 10 of FIGS. 1 and 2, the device 110 of FIGS. 3 and 4 comprises a stabilizer collar 112 coupled to the ends of a pair of stabilizer brace bars 114. In one respect, the device 110 differs by the brace bars 114 being straight and parallel to each other. A more important difference is that the device 110 uses a single flat isolator bar 118 instead of the two bars 18 seen in FIG. 1. The single isolator bar 118 is equivalent to the two isolator bars 18 with the space therebetween filled, and can be employed to further improve the comfort of the user.

While the invention has been described in terms of specific embodiments, it is apparent that other forms could be adopted by one skilled in the art. For example, the barbell 116 of FIG. 3 could be equipped with two of the stabilizer-isolator device 10 shown in FIGS. 1 and 2, instead of the device 110 shown in FIGS. 3 and 4. Accordingly, the scope of the invention is to be limited only by the following claims.

What is claimed is:

1. A stabilizer-isolator device for weight training equipment, the stabilizer-isolator device comprising:

a pair of brace bars having corresponding first and second ends, the brace bars mounted at the first ends thereof to a weightlifting bar;

a collar interconnecting the second ends of the brace bars, the collar being disposed in a plane substantially transverse to the brace bars and defining an opening therein; and at least one isolator bar substantially transverse to the brace bars and interconnecting the brace bars so as to be spaced apart from the first and second ends of the brace bars, the at least one isolator bar comprising a single member with a flat surface or at least two parallel members spaced apart from each other;

wherein the weightlifting bar comprises two oppositely-disposed end sections that are substantially coaxial with each other, a midsection therebetween that is substantially parallel to the end sections but not coaxial with the end sections so that the midsection is axially offset from the end sections in a first direction, a first grip between the midsection and a first of the end sections, a second grip between the midsection and a second of the end sections, and interconnecting sections between the first end section and the first grip, the first grip and the midsection, the midsection and the second grip, and the second grip and the second end section, the interconnecting sections being nonparallel to the end sections and the midsection, the first ends of the brace bars of the stabilizer-isolator device attached to the interconnecting sections adjacent the first grip, the first and second grips being substantially parallel to the end sections and the midsection but not coaxial with the end sections and the midsection so that the first and second grips are axially offset between the end sections and the midsection.

2. A stabilizer-isolator device according to claim 1, wherein the at least one isolator bar is offset from a diametrical chord of the collar.

3. A stabilizer-isolator device according to claim 1, wherein the collar is connected to the brace bars so that the second ends of the brace bars are located at opposite ends of a diametrical chord of the collar, and the at least one isolator bar is offset from the diametrical chord of the collar.

4. A stabilizer-isolator device according to claim 1, further comprising a cushion member surrounding the at least one isolator bar.

5. A stabilizer-isolator device according to claim 1, wherein the at least one isolator bar consists of the single member with the flat surface.

6. A stabilizer-isolator device according to claim 1, wherein the at least one isolator bar consists of the two parallel members spaced apart from each other.

7. A stabilizer-isolator device according to claim 1, wherein the stabilizer-isolator device is metallurgically joined to the weightlifting bar.

8. A stabilizer-isolator device according to claim 1, wherein the brace bars of the stabilizer-isolator device extend away from the weightlifting bar in a second direction that is substantially diametrically opposite to the first direction.

9. A weightlifting bar comprising an elongate member and at least one stabilizer-isolator device that comprises:

a pair of brace bars, each of the brace bars having a first end attached to the elongate member and an oppositely-disposed second end;

an annular-shaped collar interconnecting the second ends of the brace bars, the collar being disposed in a plane substantially transverse to the brace bars and defining an opening therein, the collar connected to the brace bars so that the second ends of the brace bars are located at opposite ends of a diametrical chord of the collar; and at least two isolator bars substantially transverse to the brace bars and interconnecting the brace bars so as to be spaced apart from the first and second ends of the brace bars, the isolator bars being substantially parallel and spaced apart from each other and offset from the diametrical chord of the collar;

wherein the elongate member comprises two oppositely-disposed end sections that are substantially coaxial with each other, a midsection therebetween that is substantially parallel to the end sections but not coaxial with the end sections so that the midsection is axially offset from the end sections in a first direction, a first grip between the midsection and a first of the end sections, a second grip between the midsection and a second of the end sections, and interconnecting sections between the first end section and the first grip, the first grip and the midsection, the midsection and the second grip, and the second grip and the second end section, the interconnecting sections being nonparallel to the end sections and the midsection.

10. A weightlifting bar according to claim 9, further comprising a cushion member surrounding at least one of the isolator bars.

11. A weightlifting bar according to claim 9, wherein the weightlifting bar is a barbell, two stabilizer-isolator devices are attached to the barbell, and the first ends of the brace bars of each of the stabilizer-isolator devices are attached to the interconnecting sections of the elongate member so that each of the first and second grips is straddled by the first the brace bars of a respective one of the stabilizer-isolator devices.

12. A weightlifting bar according to claim 11, wherein the brace bars of each of the stabilizer-isolator devices extends away from the elongate member in a second direction that is substantially diametrically opposite to the first direction.

13. A weightlifting bar comprising an elongate member and at least one stabilizer-isolator device that comprises:

a pair of brace bars, each of the brace bars having a first end attached to the elongate member and an oppositely-disposed second end;

an annular-shaped collar interconnecting the second ends of the brace bars, the collar disposed in a plane substantially transverse to the brace bars and defining an opening therein, the collar being connected to the brace bars so that the second ends of the brace bars are located at opposite ends of a diametrical chord of the collar; and at least two isolator bars substantially transverse to the brace bars and interconnecting the brace bars so as to be spaced apart from the first and second ends of the brace bars, the isolator bars being substantially parallel and spaced apart from each other and offset from the diametrical chord of the collar;

wherein the weightlifting bar is a dumbbell, a single stabilizer-isolator device is attached to the dumbbell, and the dumbbell has a grip straddled by the first ends of the brace bars of the stabilizer-isolator device.

14. A weightlifting bar according to claim 13, wherein the first ends of the brace bars are inwardly offset from the second ends of the brace bars so that the first ends are closer together than the second ends.

15. A weightlifting method utilizing a weightlifting bar comprising at least one stabilizer-isolator device, the stabilizer-isolator device comprising:

a pair of brace bars, each of the brace bars having a first end attached to the weightlifting bar and an oppositely-disposed second end;

an annular-shaped collar interconnecting the second ends of the brace bars, the collar being disposed in a plane substantially transverse to the brace bars and defining an opening therein; and at least one isolator bar substantially transverse to the brace bars and interconnecting the brace bars so as to be spaced apart from the first and second ends of the brace bars, the at least one isolator bar comprising at least two parallel members spaced apart from each other;

wherein the weightlifting method comprises the steps of:

a user inserting the user's arm through the opening in the collar and gripping the weightlifting bar with the user's hand so that each of the parallel members of the at least one isolator bar is positioned against the wrist of the user's arm and a portion of the collar is positioned against a forearm region of the user's arm between the wrist and the elbow; and then lifting the weightlifting bar so that each of the parallel members of the at least one isolator bar applies force against the user's wrist and the portion of the collar applies force against the user's forearm region to stabilize the weightlifting bar.

16. A method according to claim 15, wherein the weightlifting bar is a barbell and comprises an elongate member and two of the stabilizer-isolator devices, and wherein the weightlifting method comprises the user inserting the user's arms in both of the stabilizer-isolator devices.

* * * * *